US005819660A

United States Patent [19]

Gegenheimer et al.

[11] Patent Number: 5,819,660

[45] **Date of Patent: *Oct. 13, 1998**

[54] AUTOMATIC CLEANING SYSTEM FOR PRESS ROLLERS AND CYLINDERS

[75] Inventors: Harold W. Gegenheimer, Mystic, Conn.; Charles R. Gasparrini, Port Chester, N.Y.; Walter H. Cano, Bridgeport, Conn.

[73] Assignee: Baldwin Graphic Systems, Inc., Connecticut, N.Y.

[ * ] Notice: The term of this patent shall not extend beyond the expiration date of Pat. No. 5,450,792.

[21] Appl. No.: 449,522

[22] Filed: May 24, 1995

Related U.S. Application Data

[63] Continuation of Ser. No. 955,694, Oct. 2, 1992, Pat. No. 5,450,792.

[51] Int. Cl.[6] ..... B41F 35/00

[52] U.S. Cl. ..... 101/425; 101/423

[58] Field of Search ..... 101/417, 418, 101/423, 424.1, 424.2, 425

[56] References Cited

U.S. PATENT DOCUMENTS

| | | |
|---|---|---|
| 3,081,191 | 3/1963 | Smith et al. . |
| 3,766,853 | 10/1973 | Gallagher et al. . |
| 3,971,312 | 7/1976 | Carli . |
| 4,074,627 | 2/1978 | Eck et al. . |
| 4,135,448 | 1/1979 | Moestue . |
| 4,254,709 | 3/1981 | Arnolds . |
| 4,632,030 | 12/1986 | Laverick . |
| 4,651,644 | 3/1987 | Kaempfe et al. . |
| 4,729,312 | 3/1988 | Rodi et al. . |
| 4,867,064 | 9/1989 | Hara et al. . |
| 4,917,012 | 4/1990 | Gertsch et al. . |
| 4,991,507 | 2/1991 | Nozaka et al. . |
| 5,150,653 | 9/1992 | Hara . |

FOREIGN PATENT DOCUMENTS

| | | |
|---|---|---|
| 0223972 | 6/1987 | European Pat. Off. . |
| 0414909 | 2/1990 | European Pat. Off. . |
| 0466203 | 1/1992 | European Pat. Off. . |
| 2614835 | 11/1988 | France . |
| 2555993 | 6/1977 | Germany . |
| 3109630 | 2/1982 | Germany . |
| 8903674 | 9/1989 | Germany . |
| 9200319 | 4/1992 | Germany . |
| 56-37068 | 8/1981 | Japan . |
| 03114748 | 5/1991 | Japan . |
| 9009283 | 8/1990 | WIPO . |

OTHER PUBLICATIONS

Patent abstracts of Japan vol. 015, No. 310 (M–1146) Aug. 8, 1991.

Arthur Von Schleusingen, *Automatic Press Washer*, Instruction Manual.

Automatic Press Ink Roller Washer, Model 430, Wes and Shetfield Presses, Aug. 15, 1991, Connecticut, relevant p., 2–1.

*Primary Examiner*—Ren Yan

*Attorney, Agent, or Firm*—Morgan & Finnegan, L.L.P.

[57] ABSTRACT

An improved apparatus and method for cleaning one or more of the rollers used in printing presses. Typically, the printing press features manual or automated devices for supplying cleaning solvent to the press during a washing operation. A blade assembly is pivotally disposed for engagement with the press roller. The blade assembly features a blade unit for scraping solid and liquid debris from the roller, and a receptacle trough for collecting used solvent as well as solid and liquid debris. In the improvement, a sheathing system is provided to supply protective sheath material to cover the blade assembly to keep the blade assembly clean during the washing operation. The sheath material preferably has a low coefficient of friction to prevent wearing of the components and is relatively thin to maintain the blade geometry for effective cleaning of the roller. An absorbent lining is disposed in the receptacle trough to absorb the used ink and solvent and to protect the trough from soiling during the washing operation. The sheathing system is automatically actuated either upon the pivoting engagement of the blade assembly with the press roller or when the blade assembly is pivoted away from the press roller.

18 Claims, 10 Drawing Sheets

AUTOMATIC CLEANING SYSTEM FOR PRESS ROLLERS AND CYLINDERS

This is a continuation of U.S. application Ser. No. 07/955,694 filed on Oct. 2, 1992, now U.S. Pat. No. 5,450,792.

FIELD OF THE INVENTION

This invention relates to an improved cleaning assembly for cleaning solid and liquid debris from the various cylinders and rollers of a printing press, and more particularly, to an improved cleaning assembly for cleaning solid and liquid debris from the blanket cylinder, impression cylinder plate cylinder, or the ink roller train of a printing press, having apparatus for protecting the components of the cleaning assembly from soiling during a washup operation.

BACKGROUND

One of the more difficult and time consuming tasks in a printing operation is the need to periodically clean the various printing press rollers and cylinders, such as the blanket cylinder, impression cylinder, plate cylinder and, in particular, the ink rollers (collectively referred to as an "ink roller train") of ink and other debris. These cleaning operations are sometimes referred to by those skilled in the art as "washings" or "washup" operations. Such washup operations are needed to remove extraneous paper dust, debris, and other contaminants from the ink roller train to improve the quality of the printed product. An ink roller train washup operation is also required when ink color changes are implemented by the press operator.

Ink roller washings are tedious operations, often requiring significant (and sometimes dangerous) manual intervention on the part of the press operator. The print operator will usually "squirt" or otherwise apply a cleaning solvent directly onto the print cylinders and ink roller train. The solvent loosens the ink and other debris from the cylinders and ink rollers, which is then scraped off or otherwise removed from the printing press. The scraping operation is a messy and time consuming task, and in the past has involved manually wiping the surface of the cylinders and rollers so that the solvent, along with the ink and other solid debris, can be collected in a trough or pan, or alternatively, captured by a rag or some other absorbent material.

As an alternative to manually cleaning the printing press, the washup operation may also be performed by devices designed to engage the cylinders or ink rollers and scrape off the ink or other debris. Such devices include, for example, inflatable bladders which fill with air or other gases to lightly touch the surface of the cylinder or roller and remove debris. Devices using a wiping blade have also been used to scrape debris from cylinders and inking rollers. However, it is frequent that the blade is inadequately cleaned following a washup operation. The result is that the geometry of the blade tip is altered with subsequent washings, lowering both the effectiveness of the blade in cleaning the press rollers, and lessening the effective life expectancy of the blade.

FIGS. 1A and 1B illustrate in perspective a prior embodiment of a press washer system for inking rollers. One example of such a prior art system is the Model 430 "Automatic Press Ink Roller Washer" manufactured by Baldwin Graphic Products of Stamford, Conn. As shown in FIG. 1, a typical prior art press washer system 10 includes a blade assembly 24 pivotally mounted onto the printing press 14 with a blade unit 12 serving to clean the inking roller train 16. The blade assembly 24 is pivoted into engagement with the roller train 16 via a piston actuation means 52 controlled by a solenoid 54. The system 10 also includes, for example, one or more spray bars 20 mounted at or near the top end of ink roller train 16. The spray bars 20 supply cleaning solvent or fluid onto the ink roller train 16. Excess solvent is collected in a spray bar drip pan 22 mounted beneath the spray bars 20, and returned to a collection system (not shown). The solvent flows through the individual rollers forming the inking train 16. Through pressing action between the rollers, ink and debris is removed therefrom, flowing to the lower portion of the ink roller train 16.

As shown, the system 10 has the blade assembly 24 pivotally mounted to the press frame at a lower portion of the inking roller train 16. The blade assembly 24 removes ink, debris, or other contaminants from the ink roller train 16 during a washings operation, and accumulates such debris in a drip pan or receptacle trough 18. Upon actuation of the blade assembly 24, the blade unit 12 engages a roller 15 of the inking train 16 to remove the ink and solvent that has been released from the inking train 16. The ink and solvent is then collected in the press washer trough 18 for final disposal. However, both the blade unit and trough are unprotected from being stained or soiled by the ink and solvent; are subject to the deleterious effects, such as blade wear, as previously noted; and thus require significant manual operator intervention during and following a washup operation.

A typical press washer system may also include a controller 40 (shown in FIG. 2) for controlling the operation of the press washer system 10. In some cases, the controller 40 allows a press operator to simultaneously control a plurality of separate press washer systems 10. The controller 40 usually includes commercially available software, electronic components and internal circuitry known to those skilled in the art, for controlling the washer systems 10. As illustrated in FIG. 2, the system controller 40 is operatively connected to an operator control panel 42 having a plurality of keypad inputs for controlling critical features of the systems 10. For example, through use of the keypads, the press operator may enter system parameters and information, including spray wash time, press cleaning time, and other variables that dictate operation of the press washer systems 10.

Typically, input connections 45 to the individual washer system 10 are linked through a fluid/air box 46, to control the supply of cleaning solvent and pressurized air from central sources designed to supply a plurality of press washer systems 10. As illustrated in FIGS. 2 and 3, the individual fluid/air boxes 46 include one or more solvent valves 48 and an air valve 50 to regulate the supply of solvent fluids and pressurized air to each individual washer system 10. The solvent valves 48 are operatively connected to the individual spray bars 20, while the air valve 50 is operatively connected to a piston actuation means 52 (as shown in FIG. 1B) for controlling actuation of the blade assembly 24. These valves 48, 50 are individually controlled by solenoids 54 whose operation is controlled by the system controller 40. Thus, the press operator can control opening and/or closing of the valves 48, 50 by operating the appropriate solenoid 54 through information input into the control panel 42. Entry of this information sends signals to the system controller 40, which controls actuation of the solenoids 54 in the individual air/fluid boxes 46, and regulates the amount and duration of solvent emissions through the spray bars 20 and air emission into the actuation means 50 for controlling actuation of the blade assembly 24 against the roller 15.

The final aspect of the washup operation entails the collection and disposal of the fluid and solid wastes removed from the inking roller train 16. An inherent disadvantage with systems such as those described above comes from the liquid and solid debris that is collected in a tray or pan. In these systems, the pan often forms a permanent fixture of the ink roller washings unit, and has to be painstakingly removed from the printing press in order for the pressman to dispose of the liquid and solid debris collected therein. Another disadvantage with systems such as these described above is that none of the system components are protected from staining by ink, solvent or debris. Upon completion of the washings operation, it is necessary to manually clean the collecting pan, the bladder or blade, and other components of the washings assembly prior to renewing printing operations. Such tasks are tedious, time consuming and messy, and result in prolonged periods of press downtime while the operator cleans the stained components. As a result of these inconveniences it is often the case that washups are neglected by the operator, causing undue wear to the components and lessening their life expectancy.

One approach to addressing these problems is disclosed, for example, in PCT Application JP90/00191, directed to a "Method and Device for Cleaning an Ink Roller Train for use in Printing Machines." Referring to FIG. 8 of the reference, a special cleaning cloth, chemically treated with an oil coagulant, is used in conjunction with a doctor blade to scrape softened ink from an ink roller and onto the cloth so that it is absorbed. The device requires special heater apparatus to heat the cleaning cloth so as to melt the oil coagulant in order that it mix with the ink. The cloth is then allowed to air-cool, so that the ink is gelatinized within the cleaning cloth for disposal. The approach taught by this reference entails use of special machines, including heater apparatus disposed on the underside of the ink collection pan, and is not readily amenable to retrofit applications to existing printing presses. Moreover, this prior device is not directed to preventing or reducing the soiling of the system components utilized during the washup operation, instead employing the special cleaning cloth as a complicated means unto itself for collecting waste ink and solvent from the system. The operator would still need to clean the system components after washup operations.

There exists a need, therefore, for a washup device for the various cylinders and rollers and inking system rollers used in printing presses, and in particular, for an improvement to the blade assembly, which facilitates the automation of washings operations; which is easily retrofitted into existing printing presses without the need for complicated additions; which keeps the blade clean to prolong its life and reduce wear, so that the blade can maintain its geometry to effectively scrape the ink rollers during washup; and which simplifies disposal of the collected solid and liquid wastes while eliminating the time and effort necessary to clean the washings components between washings operations.

It is therefore an object of the present invention to provide an automatic press washer system having an improved blade assembly and a sheathing system for the washup components for use in cleaning the various press rollers and the ink roller train of a printing press.

It is an additional object of the present invention to provide on automatic press washer system having an improved blade assembly with a sheathing system for cleaning the cylinders and ink roller train of a printing press, which reduces the time and effort required to clean system components between washings operations.

It is a further object of the present invention to provide an automatic press washer system having an improved blade assembly for cleaning the cylinders and ink roller train of a printing press, which facilitates the removal and disposal of used solvent, ink, and solid debris collected from the various press rollers and the ink roller train following a washings operation.

It is yet an additional object of the present invention to provide an automatic press washer system having an improved blade assembly for cleaning the cylinders and ink roller train of a printing press which is easily retrofitted into existing printing press units without the need for extraneous components.

It is still an additional object of the present invention to provide an automatic press washer system having an improved blade assembly for cleaning the cylinders and ink roller train of a printing press, which protects the individual components from being soiled, stained, or covered by ink, solvent or debris during a washings operation.

The foregoing specific objects and advantages of the invention are illustrative of those which can be achieved by the present invention and are not intended to be exhaustive or limiting of the possible advantages of the invention, which will be apparent from the description herein or can be learned from practicing the invention, both as embodied herein or as modified in view of any variations which may be apparent to those skilled in the art. Accordingly, the present invention resides in the novel parts, constructions, arrangements, combinations and improvements herein shown and described.

SUMMARY OF THE INVENTION

These and additional objects are achieved by providing an improved blade assembly with a sheathing system according to the invention for use in press roller washup operations.

It is understood that the device may be employed to clean various of the cylinders found in printing presses known in the art, including the blanket cylinder, impression cylinder and plate cylinders found in offset printing presses. For the sake of simplicity, the invention is described as applied to the inking cylinders of a printing press, the invention, of course, being equally applicable to the other cylinders as previously noted.

The improved blade assembly may be employed or configured with various known washings systems as previously described. Other than manual application of the solvent, these washings systems might include one or more spray bars positioned at the top portion of the ink roller train to apply cleaning solvent onto the train to loosen the ink and debris from the rollers. Excess solvent is collected in a drip tray located downstream of the spray bars. The improvement to the system includes a blade assembly which is affixed to the press. The improved blade assembly is provided and positioned into and out of engagement with an ink roller to scrape off the ink, excess solvent, and other debris which has been dislodged from the ink roller train.

The entire blade assembly is pivotally mounted to pressingly engage an inking roller upon command from a system controller. The blade assembly has a resilient blade member to scrape debris into a receptacle or trough for collection.

Notably, the blade unit may be protected with a sheathing system to significantly reduce blade wear and prolong its life, while at the same time preventing the blade member from being contaminated or stained during the washings operation. The sheathing system may be implemented in a variety of manners. In its preferred embodiment, the sheathing system is configured as a device feeding a clean portion of a continuous sheath material obtained from a roll supply.

Preferably, the sheath material is impervious to liquids, resistant to chemicals, and possesses a low coefficient of friction ($\mu$) to enable the blade to slidingly engage any of the rollers which may be encountered in use, without undue scraping or heat build-up. These conditions may be particularly prevalent, for example, when an insufficient amount of solvent is used or released during washup, so that by use of the protective sheathing, the blade unit may act against the roller without undue friction or squeal.

A take-up roll may be mounted within the confines of the receptacle trough to retract the used portion of the sheath material. Advantageously, the supply and take-up rolls are meshingly linked by a mechanism which is actuated either by the pressing engagement of the blade assembly with the inking roller, or when the blade assembly is retracted therefrom. The pivoting actuation of the blade assembly automatically advances clean sheath material from the supply roll and retracts used sheath material onto the take-up roll, eliminating the need for additional motors or other devices to advance or retract the sheath material, and relieving the need for manual intervention on the part of the press operator.

In other embodiments, the sheathing system can be configured, for example, as a "slip-on" embodiment which covers the blade; or as a removable shield formed to the contours of the blade member.

The receptacle trough may be formed as a permanent fixture of the blade assembly, or as an inexpensive removable unit that may be disposed intact with the solvent and ink accumulated therein. In the preferred embodiment, the trough may be lined with an absorbent wadding to protect the trough from soiling and to absorb the ink and solvent collected from the ink train.

The blade sheath may extend slightly beyond the blade unit to cover a portion of the interior of the receptacle trough, further protecting the trough from contamination during washings. In other embodiments, the trough may also be supplemented by or, with modification to the blade assembly, replaced by a disposable bag like insert which is affixed to a frame, and supported on the blade assembly.

BRIEF DESCRIPTION OF DRAWINGS

The invention will now be described by way of reference to the following drawings, in which.

DETAILED DESCRIPTION OF THE DRAWINGS

Turning now to the drawings, in which like numerals denote like components, there is illustrated an automatic press washer system according to the present invention. As previously noted, the device is described in connection with cleaning the ink roller train of a printing press, it being understood, of course, that the device be employed to clean other rollers or cylinders, such as the plate cylinder, impression cylinder, or blanket cylinder of printing presses.

Figure 1A:
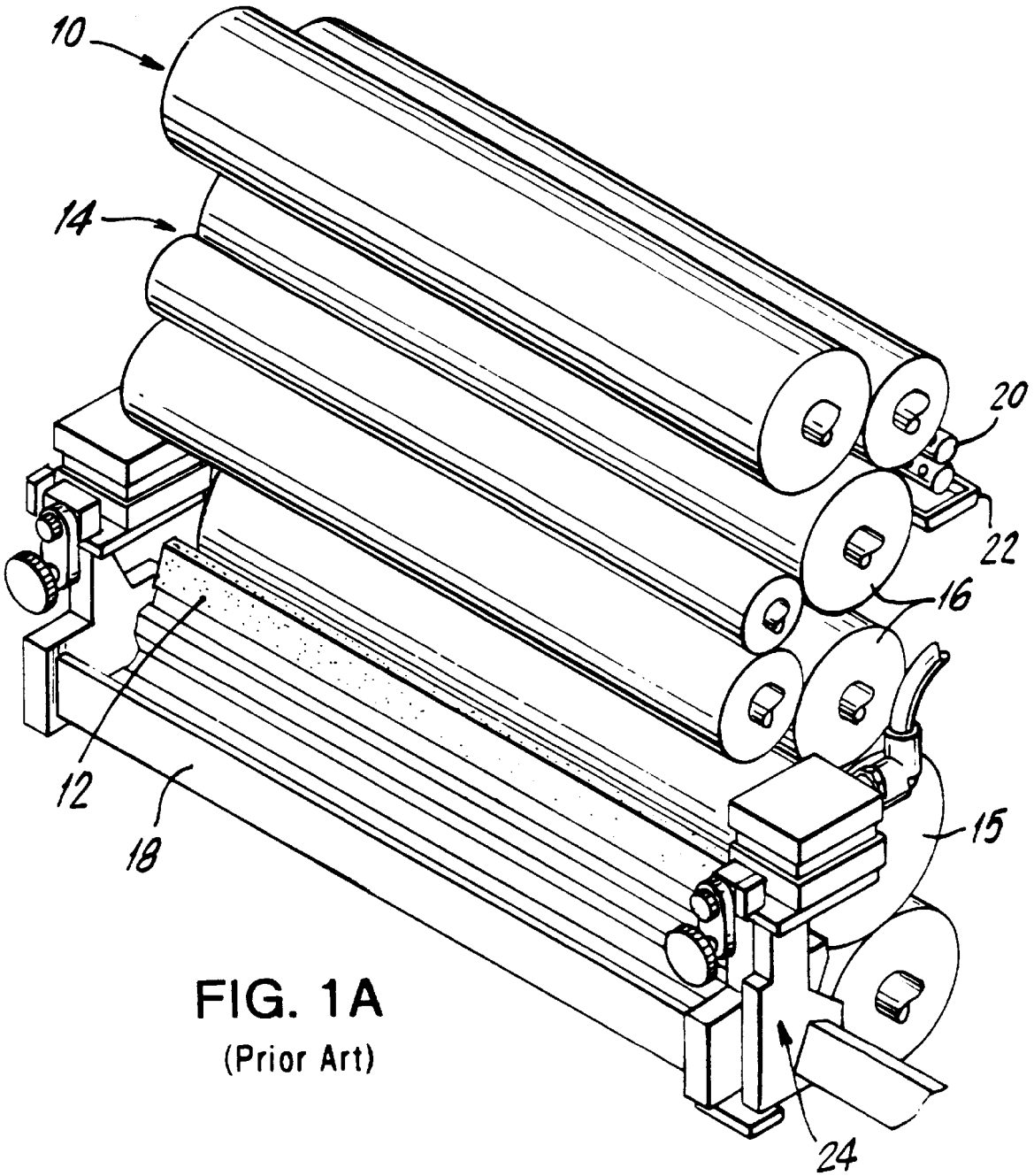
FIG. 1A (Prior Art)
FIG. 1A is a perspective view of a prior art press washer system employing a trough unit of the fixed type.
Figure 1B:
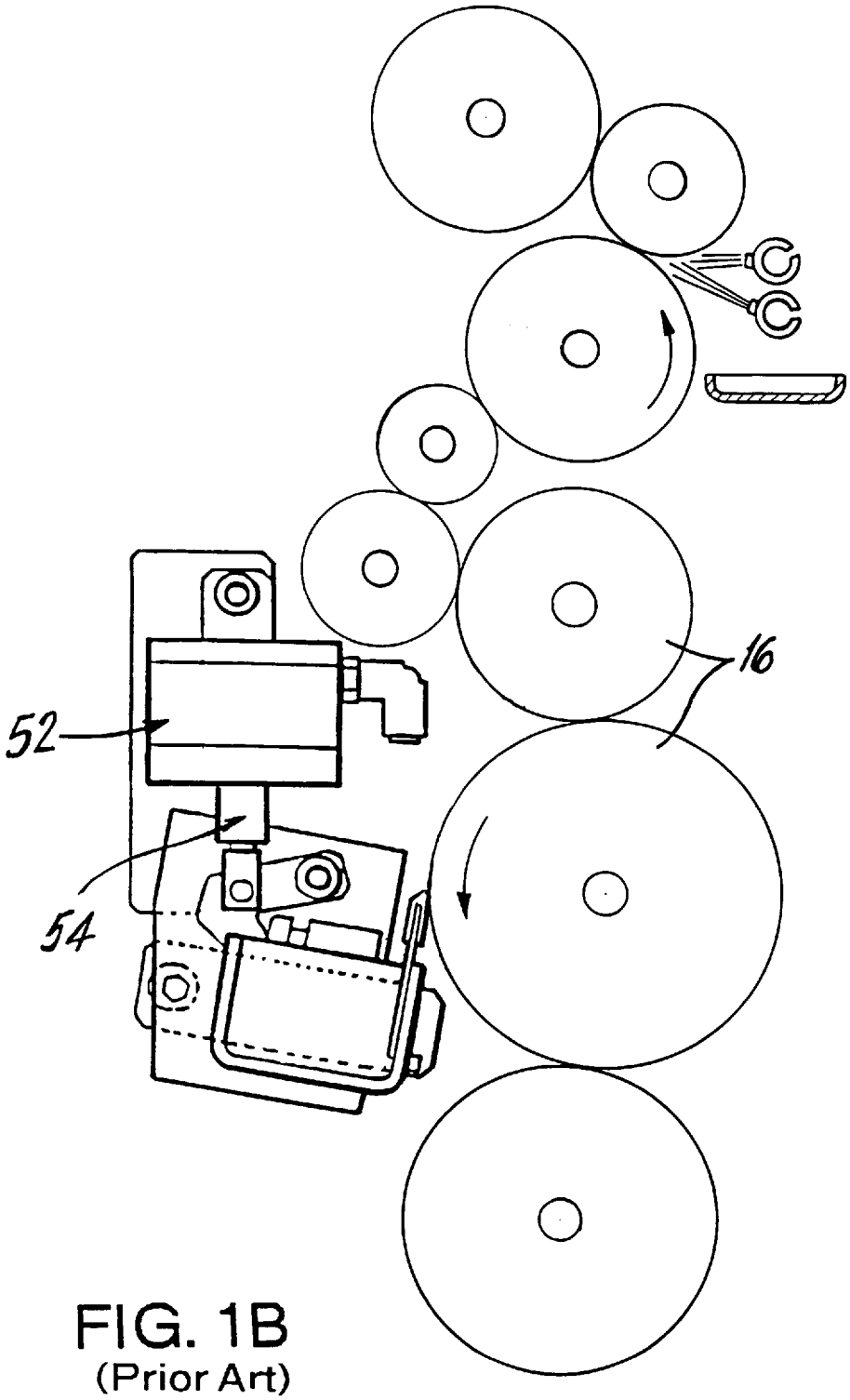
FIG. 1B (Prior Art)
FIG. 1B is a sectional side view of a prior art press washer system employing a trough unit of the fixed type.
Figure 2:
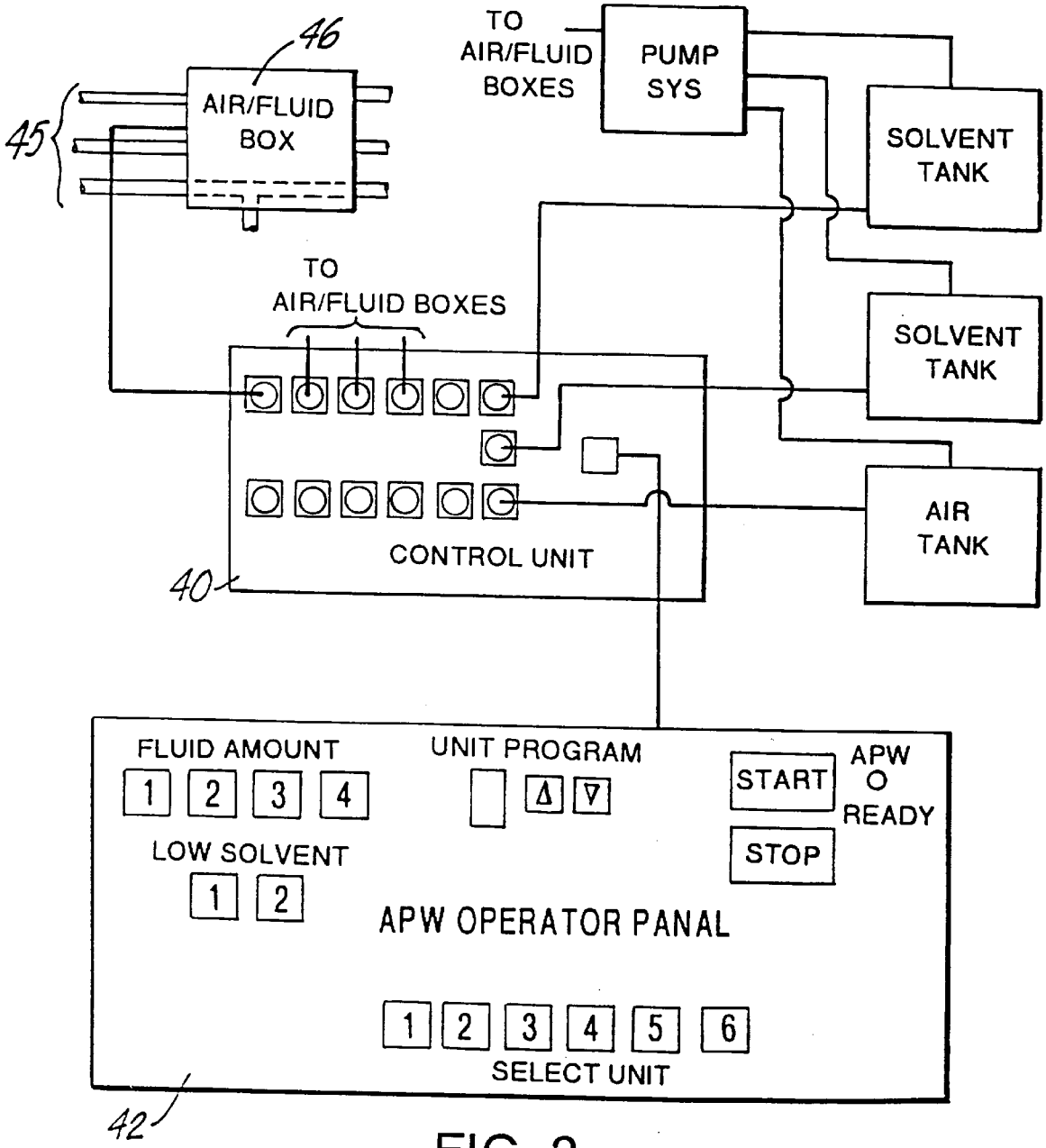
FIG. 2 (Prior Art)
FIG. 2 is a diagrammatic view of the connection between the system controller/control panel/individual control boxes according to an embodiment of the present invention.
Figure 3:
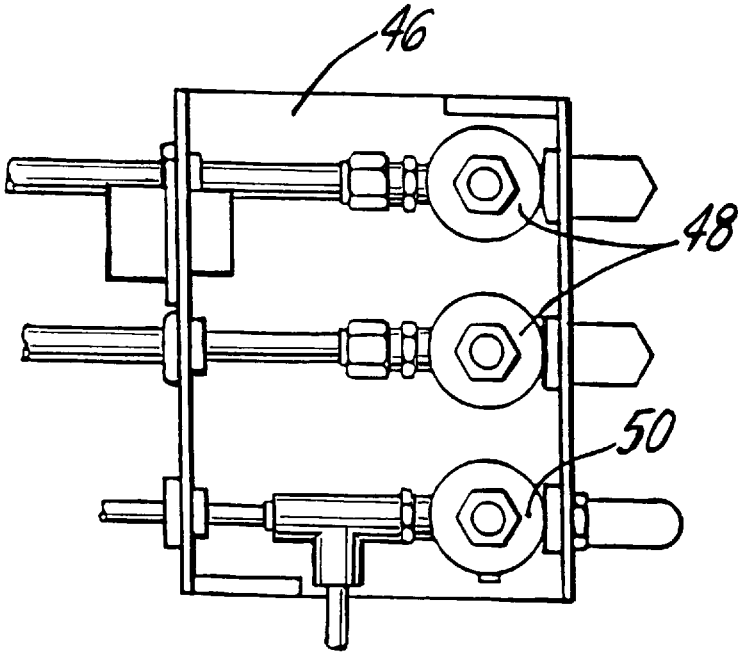
FIG. 3 (Prior Art)
FIG. 3 is a see through diagrammatic view of a fluid/air box having solvent and air valves.
Figure 4:
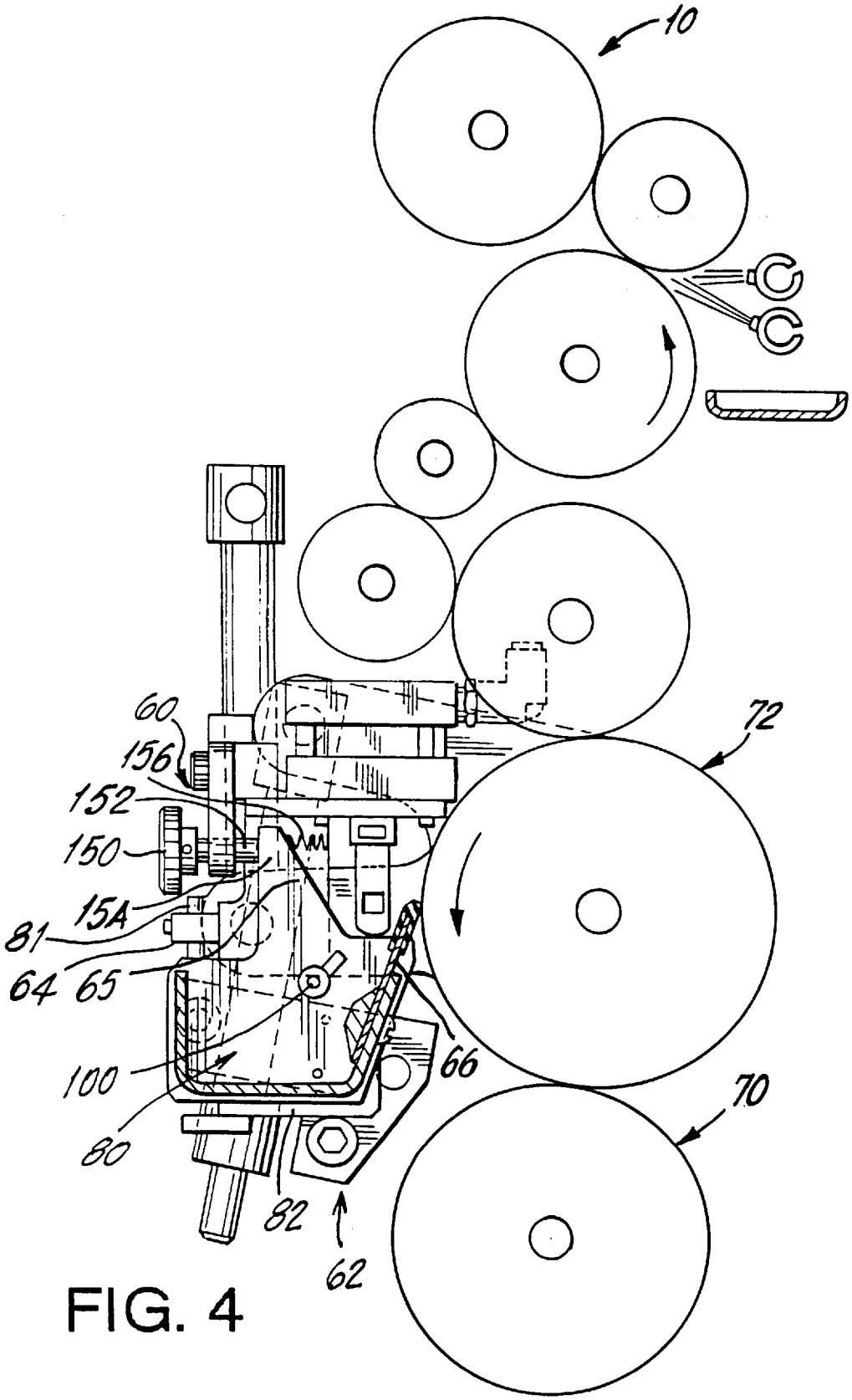
FIG. 4 is a sectional side view of an embodiment of a blade assembly in accordance with an embodiment of the present invention.

As illustrated in FIG. 4, an improved blade assembly 60 is pivotally affixed about a fixed stud type pivot 100 attached to the frame 62 of a press, and includes a blade unit 64 for engagement with a bottom most ink roller 72 of the inking roller train 70. The blade assembly 60 is generally pivotal between two operative positions. In a first operative position, the blade unit 64 is biased away from the inking roller 72 so that there is no contact between the blade unit 64 and the inking roller 72. In the second operative position, the blade unit 64 is held in contact with the surface of the inking roller 72 to effect cleaning and removal of debris from the inking roller 72.

Pivoting of the blade assembly 60 between the first and second positions described above is effected by an actuator 65 affixed to the frame 62 of the press that engages the blade assembly 60 to rotate the blade assembly about pivot 100. It is preferable to use a pneumatic actuator since compressed air is commonly available in press room environments. However, the use of a pneumatic actuator is not critical to the invention, and suitable electrical or hydraulic actuators may also be used in the present invention.

As illustrated, the blade assembly also features manual actuation means, provided either as an override should actuator 65 fail, or means unto itself for pivoting blade assembly 60 into operative position. Here, an actuation knob 150 is rotatably threadedly affixed through the frame 62. The knob 150 includes a fixed shaft 152 in engagement with a bracket 154 attached to the blade assembly 60. A spring 156 is affixed at either end to the bracket 154 and frame 62. In operation, the press operator may rotate the knob 150 to cause fixed shaft 152 to press against bracket 154, causing the blade assembly 60 to pivot clockwise about pivot 100 for engaging the blade unit 64 against inking roller 72. Upon actuation, spring 156 is compressed, and the spring will provide a biasing force to urge the blade assembly 60 counterclockwise about pivot 100 when the operator desires to disengage the blade assembly 60 by rotating knob 150 and shaft 152 in the opposite direction.

The blade unit 64 includes a length wise blade 66 with a semi rigid pliable member 68 preferably formed of rubber, plastic or the like which actually engages with the lower most inking roller 72 to scrape the solvent and ink therefrom. The pliable member 68 is preferably soft enough not to damage the surface of the inking roller 72, but resilient enough to provide rigidity to thoroughly scrape ink, solvent and debris from the roller 72.

The blade assembly 60 includes a collection tray or trough 80 located below the blade unit 64, and which runs lengthwise parallel to the axis of inking roller 72. As illustrated, the collection tray 80 has a generally open end 81 for allowing solvent and ink scraped from the inking roller 72 to enter into the interior of the tray 80 for collection. The tray 80 may be affixed, for example, to an L-shaped support 82 forming part of the blade assembly 60. The tray 80 preferably has a rectangular cross-section, but it is not so limited. As may be apparent to those skilled in the art, other shapes appropriate to the press design or convenient to the user can be employed to provide the functions described above.

The tray 80 may be formed from moldable materials, such as steels, plastics, rubbers, vinyls, or from any inexpensive material suitable therefore (for example, formed metals such as aluminum or tin). However, it may also be made from paper materials such as cardboard (preferably coated in its interior with a waterproof substance, such as wax or plastic) when the tray 80 is intended for disposal and not for reuse.

The tray 80 may be configured as a non-disposable unit, forming a permanent part of the blade assembly 60. As will be later described, the tray 80 may be lined with an absorbent material 93 to protect the interior of the tray from soiling and to collect the dissolved ink/solvent scraped from ink train 70. Thus, the tray 80 may be conveniently prevented from being soiled during the washup operation.

Alternately, the tray 80 may be detachable from the blade assembly 60 in manners known to those skilled in the art to permit routine cleaning and reuse. In this manner, once the tray 80 is filled with collected ink and solvent following the washings operation, the pressman may simply release the soiled tray 80 from the support 82 and quickly clean it or replace it with a clean one. Advantageously, the soiled tray 80 may be placed aside for later draining of the solvent/ink and cleaning so that it might be re-used.

The tray 80 may also be formed as a detachable unit that is suitable for disposal once filled with solvent/ink. In this configuration, the soiled tray 80 may be discarded, intact and according to accepted procedures for the disposal of inks and solvents, to rapidly and conveniently dispose of the ink/solvent. As with the permanent tray configuration, the L-shaped support 82, pivotal as part of the blade assembly 60, supports the disposable tray 80. The disposable tray 80 is substantially configured to the dimensions of the support 82. The support 82 may be modified to include a plurality of clips or other devices known to these skilled in the art (not shown) for releasably supporting and attaching the tray 80 in manners known to those in the art.

In order to prevent contamination of the various system components, the invention includes a sheathing system 170 to protect the blade unit 64 and trough 80 from soiling during the washup operation.

Characteristically, the material employed for the sheathing system 170 ought to possess a number of basic qualities. The material should be heat resistant to withstand the range of operating temperatures (typically 10°–150° C.) normally encountered in use.

The sheath material should also possess a relatively low coefficient of friction ($\mu$), so that blade 68 will run smoothly and effectively over the surface of the roller 72. In use, coefficients of friction will vary depending upon the roller covering (for example, steel, rubber or cloth), and the amount of solvent present (solvent, of course, acting as a lubricant). It is believed that the sheathing material should possess a dynamic $\mu$ in the range of 0.10 to 0.40 to enable the blade to smoothly engage the various roller surfaces which may be encountered regardless of the amount of solvent which may be actually present in the system.

Thus, the advantages of a low coefficient are multiple: it prevents excessive heat build up and wear, which would be especially prevalent where there is not enough solvent provided during the washup cycle; it promotes the effective life expectancy of the blade 68; and it deters the blade 68 from accidentally deflecting beneath and getting pulled under by the press rollers, which can occur if there is a deficit of solvent and the friction level is elevated between blade 68 and roller 72.

Another characteristic is that the sheath material should be relatively thin (i.e., in the range of 0.48–10 mils). A thin material is necessary in order to preserve the geometry of the blade tip 68*a* to allow the blade 68 to effectively clean the roller 72.

Other basic mechanical characteristics for the sheath material include: abrasion resistance; chemical resistance (to withstand the various solvents and chemicals encountered in washup operations); good dimensional stability at elevated temperatures; and good sheer strength. Numerous materials have been tested for the sheath material, including: PTFE film, "Kapton" film, or VHMW polyethylene, all produced by the 3M Corporation; various types of wax type papers, including "freezer wrap", "deli fresh paper", and "SnowFibre-Kold Lok Polymer", all produced by the James River Corporation; and teflon. It has been found, however, that Mylar (produced by DuPont Corporation), with a thickness in the range of approximately 0.50–2 mils, is well suited to achieving the characteristics described above, with a thickness of 1.0 mil providing the best results. It is believed that when operating dry (i.e., without solvent), Mylar exhibits a dynamic $\mu$ of 0.20 for a steel covered roller and 0.28 with a rubber covered roller, well within the ranges believed adequate for effective use as described above.

The sheathing system 170 may be configured in a number of ways, and it is understood that all embodiments may be used with either a tray 80 forming a permanent part of the blade assembly 60, or with a tray 80 that is intended to be disposable.

Figure 4A:
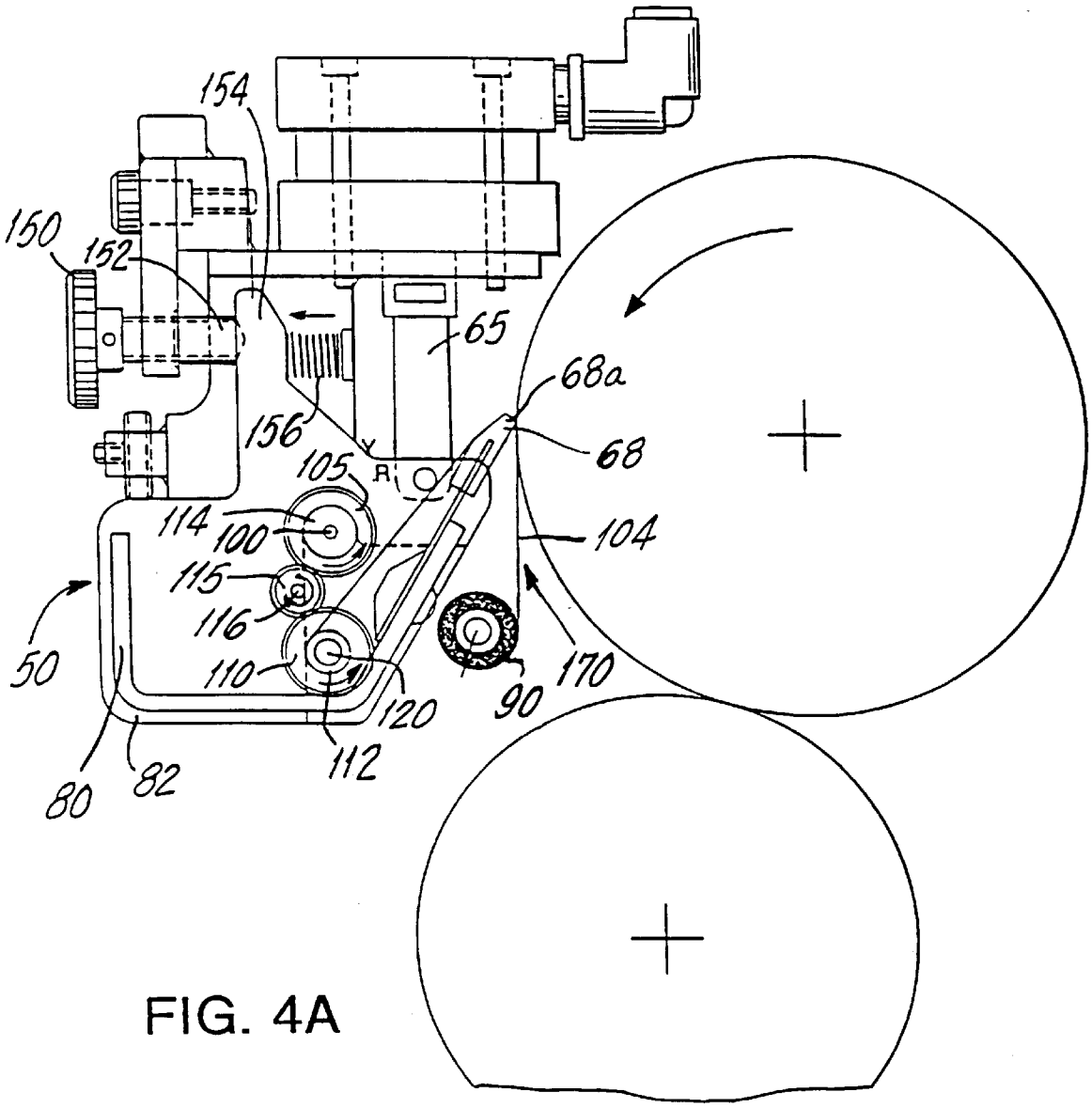
FIG. 4A is an expanded sectional view of the blade assembly in FIG. 4 illustrating a preferred embodiment for implementing a sheath system according to the invention.

FIG. 4A illustrates an enhanced sectional view of the blade assembly 60 illustrated in FIG. 4 showing a preferred embodiment for automatically actuating the sheathing system 170 upon actuation of blade assembly 60.

A supply roll 90 of sheath material is inserted about a fixed supply shaft 102 attached to the outside of trough 80. The supply roll 90 is free to rotate about supply shaft 102 to supply sheathing material 104 in a manner to be explained hereafter. Advantageously, the supply roll 90 may be released from the supply shaft 102, in manners known to those skilled in the art, to permit replacement of used supply rolls 90.

Affixed to the outside of tray 80 are a pair of gears 105, 110 and a center gear 115. The center gear 115 is rotatably affixed about an axle 116 attached to the tray 80 and is meshed with both of the gears 105, 110. Center gear 115 is free to rotate in both the clockwise and counterclockwise directions.

Gear 105 is affixed to a one-way clutch bearing 114 that is disposed about the pivot 100 affixed to the frame 62. Gear 110 is affixed to a take-up shaft 120. The shaft 120 is rotatably affixed at either end to the sides of tray 80, and extends lengthwise through the interior of tray 80. The take-up shaft 120 may be configured in a releasable manner, as known to those in the art, to permit the operator to remove it as need or desire dictate. As shown, one end of take-up shaft 120 is disposed through a clutch bearing 112 journaled in one side wall of tray 80.

In operation, actuator 65 (or, as previously described, manual actuation via knob 150) is activated to rotate blade assembly clockwise about pivot 100. The one-way clutch bearing 114 is oriented to lock about pivot 100 during actuation, so that as blade assembly 60 is actuated into position, gear 105 is locked and prevented from rotating about pivot 100. In essence, gear 105 becomes a "locked" gear upon actuation of blade assembly 60, so that as the blade assembly is rotated clockwise about the pivot, center gear 115 travels clockwise in space about pivot 100. Gear 105 is locked with pivot 100 and cannot rotate about pivot 100 while gear 115 is meshed with gear 105, so that gear 115's motion clockwise in space about gear 105, and change "This causes" to will cause gear 105 to act as a planetary driving gear to cause center gear 115 to rotate clockwise, driving gear 110 (and its take-up shaft 120) counterclockwise to reel in previously used sheath material and advance a clean supply of sheathing material 104 from supply roll 90. In order to prevent used portions of sheath material 104 from retracting back onto roll supply 90 as the blade 64 is engaged against the surface of inking roller 72, the clutch bearing 112 is oriented to lock about shaft 120 while the blade 68 is engaged against the surface of inking roller 72. Thus, shaft 120 (and consequently gear 110) is prevented from rotating clockwise and, hence, used portions of wheath material cannot retract back onto roll supply 90. Advantageously, the number of teeth and gearing ratios for each of the gears 105, 110 and 115 may be selected to retract an appropriate length of clean sheathing material from roll supply 90 so that the engaging tip 68*a* of cleaning blade 68 will be fully sheathed by clean sheath material during a washing operation. Typically, the minimum length of sheathing material required is approximately one-quarter inch (¼"). Thus, the device may be configured so that just the required length of sheath material 104 is expended during a washing operation, thus greatly extending the life and usefulness of each sheath supply roll 90.

When the washup operation has been completed, the actuator 65 is deactivated. Spring 156, previously compressed during actuation, now biases the blade assembly 60 counterclockwise about pivot 100. One-way clutch 114 is released when blade assembly 60 is deactuated, so that gear 105 is free to rotate respective to the pivot 100. Upon deactivation, then, the whole blade assembly 60 rotates about the pivot 100, and as gear 105 is free to rotate about the pivot along with the blade assembly, none of the gears 105, 110 or 115 are rotated respective to one another. Used sheath material 104 thus cannot retract from the take-up shaft 120 back on to roll supply 90.

Figure 4B:
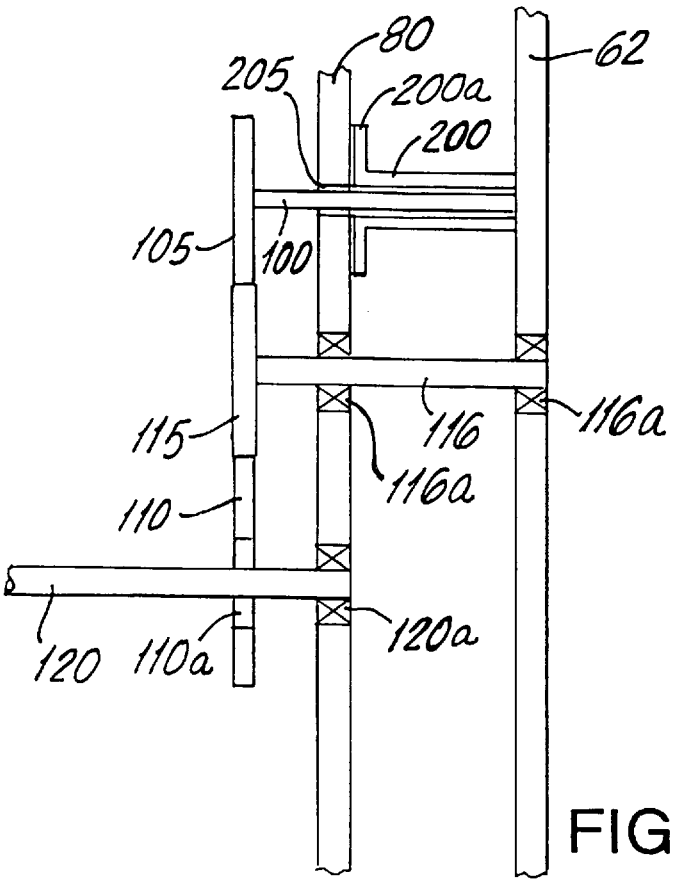
FIGS. 4B and 4C illustrate a second manner for implementing a sheathing system according to the preferred embodiment.
Figure 4C:
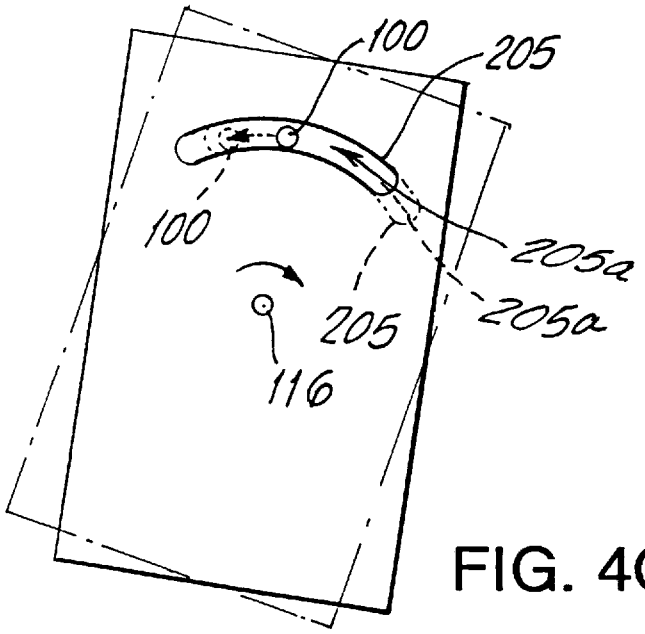

FIGS. 4*b* and 4*c* show an alternate manner for implementing automatic actuation of the sheathing system. Here, gear 105 is fixed against rotation to the end of stud 100 attached to frame 62. As will become shortly evident, stud 100 travels in an arcuate slot 205 cut through the side wall of tray 80. A guide member 200 having a flattened engaging face 200 *a* disposed slidingly flush against the outside surface of tray 80 is affixed to frame 62. As shown, guide member 200 surrounds the stud 100 to ensure that the center of stud 100 travels along the central arc 205*a* of arcuate slot 205.

As in FIG. 4*a*, gear 105 is meshingly engaged to center gear 115, itself meshed with a gear 110. As shown, center gear 115 is affixed to a pivot axle 116 affixed to the frame 62. Pivot axle 116 is free to rotate in a pair of bearings 116*a* respectively journaled into the frame 62 and the tray 80.

A one-way bearing clutch 110*a* is journaled into the gear 110. The take-up shaft 120 extends through the one-way bearing clutch 110*a* and its opposed ends are rotatably supported at respective bearings 120*a* journaled at either end of tray 80.

In operation, blade assembly 60 is engaged as previously described. The blade assembly now pivots about pivot axle 116, and stud 100 is free to travel along the length of slot 205. Gear 105, fixed against rotation, acts as a planetary gear as previously described, and as gear 105 is meshed to gear 115, it will drive gear 115 (which is free to rotate). Gear 115 drives gear 110 to rotate the take-up roll 120 in the manner previously described. The one-way clutch 110*a* is oriented so that it locks onto the shaft 120 during the actuation phase, thereby transmitting the rotational force exerted upon the gear 110 to the shaft 120.

When the blade assembly is deactuated, the clutch 110*a* unlocks, so that gear 110 can freely rotate about the shaft 120. Since no power is transmitted from gear 110 to shaft 120, shaft 120 will not rotate in its bearings 120*a*. Thus, the sheath material is prevented from being pulled away from shaft 120 back onto the take-up roll 90.

Figure 4D:
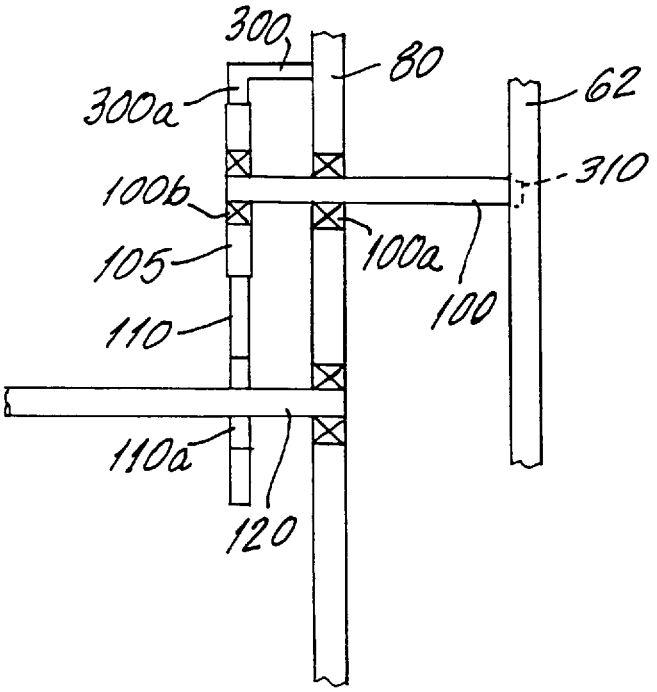
FIGS. 4D illustrates a third manner for implementing a sheathing system according to the preferred embodiment.

FIG. 4D illustrates another manner for implementing automatic actuation of the sheathing system. Here, stud 100 is fixed to the frame 62, and it passes through a bearing 100*a* journaled into the side wall of tray 80. A second bearing 100*b* is disposed at the opposite end of stud 100. Bearing 100*b* is journaled into gear 105.

A pin 300 fixed to tray 80 has a tooth 300*a* configured to the gearing dimensions of gear 105. Tooth 300*a* engages the teeth of gear 105.

Take-up shaft 120 is rotatably disposed at either end of tray 80 through a pair of bearings 120*a* journaled into the respective side walls of tray 80. The shaft 120 passes through a one-way clutch 110*a*. As shown, one-way clutch 110*a* itself is journaled into gear 110.

In operation, blade assembly 60 is pivotally actuated about stud 100 (bearing 100*a* allowing the tray 80 to pivot about the stud 100). Gear 105, which is free to rotate about bearing 100*b*, is driven by tooth 300*a* of fixed pin 300. One-way clutch 110*a* is oriented to lock onto take-up shaft 120 during the actuation phase for the blade assembly. Gear 105 thus drives gear 110 and power is transmitted to take-up shaft 120 to roll up the used sheath material.

Upon deactuation of the blade assembly 60, one-way clutch 110*a* disengages from take-up shaft 120, so that gear 110 is free to rotate about take-up shaft 120. Thus, while pin 300 engages gear 105 to rotate gear 110, power will not be transmitted to take-up shaft 120, preventing used portions of sheath material from being drawn back onto supply roll 90.

As illustrated stud 100 may be squared off at its end outside tray 80. The squared end could be releasably engaged in a corresponding notch 310 formed in frame 62. Such an arrangement would both provide fixation against rotation for stud 100, and allow a convenient means for releasing the blade assembly 60 from the press.

As will be apparent to those skilled in the art, in the embodiments shown the various components (bearings, clutches, etc.), may be configured so that the gears 105, 110, 115 may be placed either within the interior of tray 80 or outside of the tray 80.

It is, of course, understood that various other configurations may be devised for implementing actuation of the sheathing system 170. Various other configurations, both with and without a center gear 115, are possible. Also, various lever or linkage arrangements may be devised by those skilled in the art to implement automatic actuation of the sheathing system upon pivoting of blade assembly 60. Moreover, it will be apparent that the actuation systems can be configured so that the sheathing material is advanced from supply roll 90 when the blade assembly 60 is deactuated from the press roller 72, rather than upon the actuation of the blade assembly with the press roller.

Figure 11:
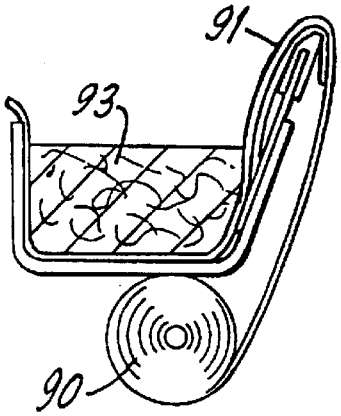
FIG. 11 illustrates an embodiment of a blade assembly according to the invention illustrating an absorbent material in the ink collecting trough.
Figure 6:
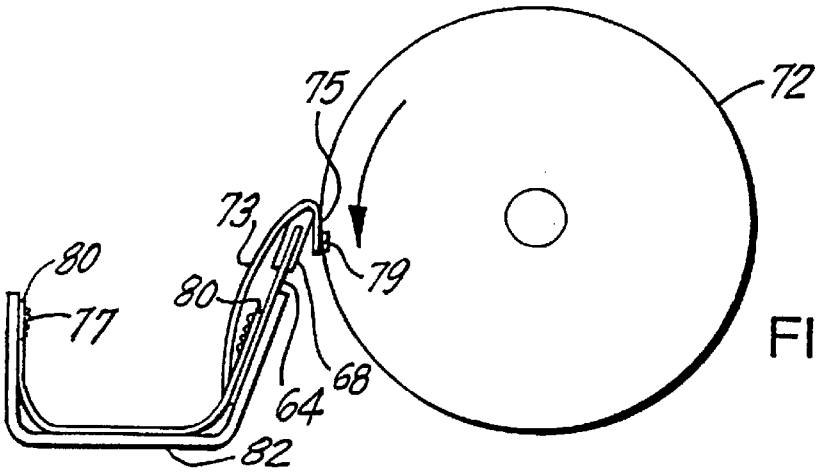

Referring to FIG. 11, in all of the embodiments herein described, the tray 80 may be lined with an absorbent wadding 93 formed to the dimensions of the tray to retain and capture used solvent, ink and debris collected from the roller train 70. Of course, it is understood the shape, size, or other dimensions of wadding 93 may be appropriately selected taking into account the placement of any components associated with the sheathing system 170 so as not to interfere with the operation of the sheathing system. It is also understood that the wadding 93 may be used in either the permanent or disposable tray 80, and in combination with the various alternate sheathing systems to be subsequently described. The wadding 93 should be highly absorbent, able to withstand, for example, a full days operation of a printing press and the attendant repeated washups conducted, so as to eliminate the need to constantly remove the wadding from the tray 80, and to protect the interior of tray 80 from soiling. Such a suitable wadding may be formed, for example, from commercial grade absorbent materials, such as the PIG® absorbent wadding manufactured by the New Pig Corporation of Tipton, Pa.

Figure 5:
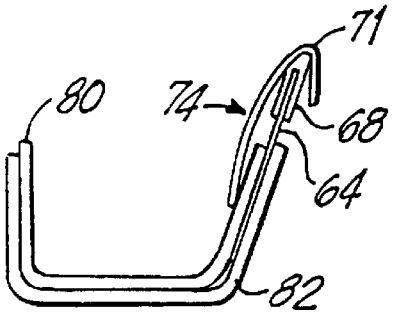
FIGS. 5–8 illustrate other embodiments of a sheathing system according to the invention.

Various additional embodiments of the sheathing system are shown in FIGS. 5–11. In FIG. 5, the sheathing system 74 may constitute, for example, a lengthwise bag 71 that is slipped over the blade member 68 prior to any printing operation. The slip on bag 71 may be formed to the dimensions of the blade member 68 and blade unit 64. The slip on bag 71, while preferably formed of Mylar, may be formed from various plastics, rubber materials, or the like, and serves to cover both the blade member 68 and the blade unit 64 during washings. Following the washup operation, the press operator need simply slip the soiled bag 71 off of the blade member 68 for rapid and convenient disposal. Advantageously, by providing a Mylar covering or shield for the blade member 68, both the wearing down of the blade member 68, as well as the deleterious effects suffered by (and the somewhat irritating squeal caused by) a dry blade member 68 contacting the ink roller 72 can be greatly alleviated.

In another embodiment, the sheathing system 74 may be formed as bag like insert 73 (see FIG. 6) which is placed directly into the interior of the tray 80 (which, as previously explained, may constitute either the permanent tray or the disposable tray). The bag like insert 73 may be formed substantially to the dimensions of the tray 80 and includes an extended lip portion 75 on one end to extend over and cover blade member 68.

Optionally, the bag insert 73 includes longitudinally extending, opposed channels 77 located at one end thereof and extending along the length of the bag insert 73. The channels 77 may be formed with a male or female member that corresponds to substantially similar and complimentary male/female channels 79 located of the lip portion 75. The two channels 77, 79 form an interlocking relationship when press joined together to permit the bag insert 73 to be sealed once it is filled with ink and solvent. This arrangement provides a neat package to simplify disposal of the ink and solvent.

A plurality of anchoring openings (not shown) may be formed directly above opposed channels 77, 79 to engage with protrusions, clips or other devices (not shown) located within the interior of the tray 80. The anchoring openings, together with the protrusions or clips, provide a means of anchoring bag insert 73 to the tray 80.

Figure 7:
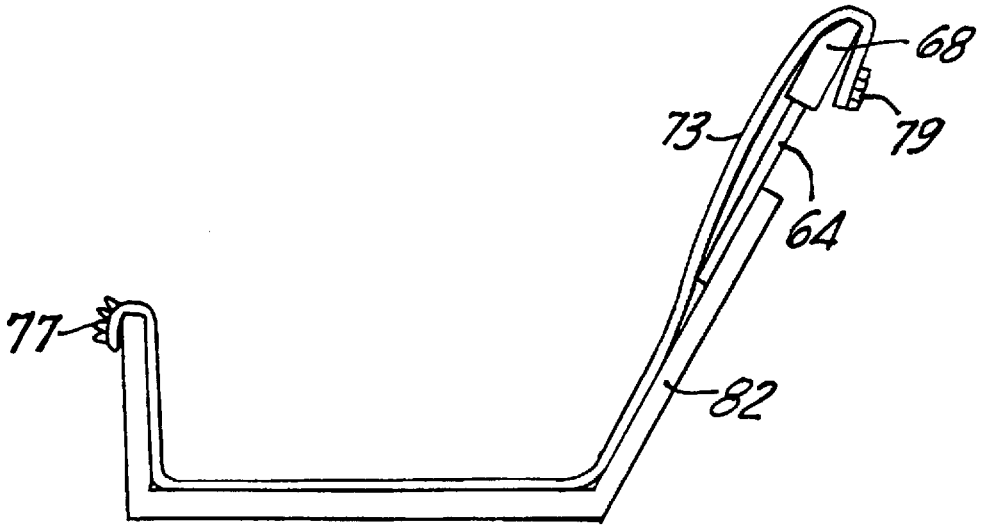

It will be understood to those skilled in the art that by employing the bag insert 73 use of a rigid collecting tray 80 may be eliminated from the blade assembly 60. As shown in FIG. 7, the blade unit 64 is directly affixed to the frame 82. The bag is supported within the frame 82 which is pivotally engaged with the press. By means of the anchoring openings or clips (not shown) located on the frame 82, the bag may be securely held open by and supported within the frame 82. The frame 82 provides lateral support for the bag insert 73, while the bag insert 73 may be formed from a sufficiently strong material, such as Mylar, to withstand the weight and any forces exerted by the ink/solvent collected therein.

Figure 8:
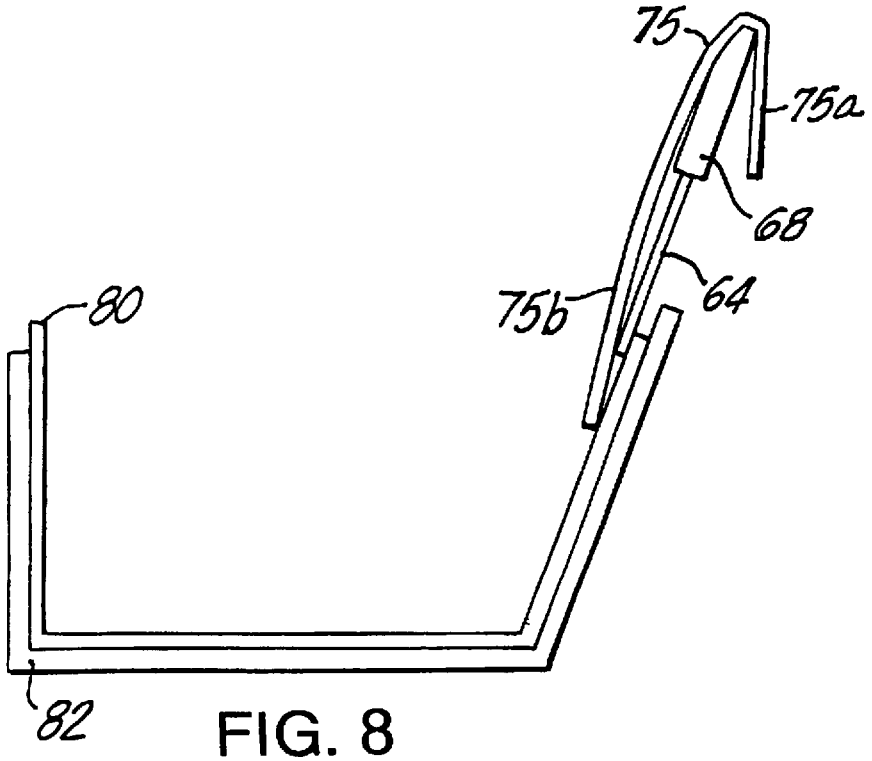

FIG. 8 illustrates yet another embodiment of a sheathing system 74 according to the invention. Here, the sheathing system 74 constitutes a shield 75 molded or formed to the dimensions of the blade member 68. The shield 75 includes a curved lip portion 75*a* which is curved to fit around the blade unit 68, and provides a planar main portion 75*b* to cover to the bulk of the blade member. The shield 75, which is preferably formed of Mylar but not so limited, may be formed from materials such as plastic, vinyl, paper products such as cardboard (which may be coated with a moisture resistant material such as wax or plastic), or other suitable materials. Once a washings is completed, the shield 75 may be removed by the press operator for disposal (or if made from a recyclable material, for later cleaning), and replaced by a fresh unit.

Figure 9:
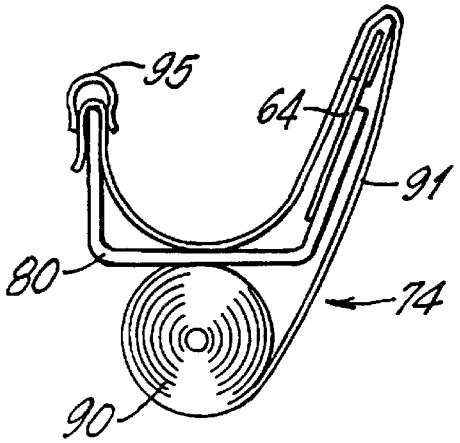
FIGS. 9 and 10 illustrate a simplified variant of the preferred embodiment of a sheathing system according to the invention.

FIG. 9 illustrates a simplified modification of the preferred configuration described in FIGS. 4A–D. Again, the sheathing material may also be supplied from a roll supply of sheath material 90 located below the receptacle tray 80. As also shown in FIG. 9, the roll is rotatably anchored below the tray 80. It is understood that for embodiments employing a disposable tray 80, the roll supply could be anchored below the L-shaped support 82.

As before, the sheath material 91 is pulled from the roll supply 90 beneath the tray 80 and over the blade member 68 to cover the blade member 68 during the washings operation. Actuation of the blade unit 64 during the cleanup securely traps the sheath 91 between the surface of roller 72 (not shown) and the blade unit 64.

Figure 10:
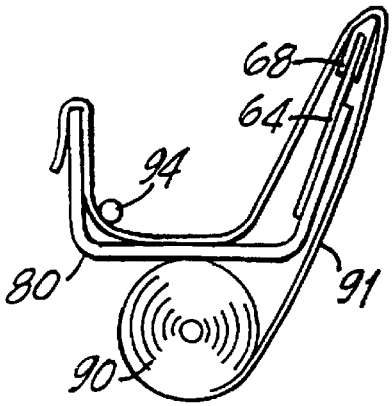

As in the preferred configuration, the sheath 91 is pulled to extend over and to cover the blade member 68 and its associated blade unit 64. The sheath 91 can extend to line the interior of tray 80, providing further protection against contamination and debris. Rather than a take-up roll, retaining clips 95 are secured over one edge of the tray 80 so that the sheath 91 may be securely engaged thereon. Alternatively, a securing rod 94, as illustrated in FIG. 10, may be placed longitudinally across the length of the tray 80. The sheath 91 would be pulled into the interior and threaded between the back wall of the tray 80 and the rod 94. It is, of course, understood that the manners of retaining the sheath 91 within the tray 80 may be employed with all embodiments of tray 80. Additionally, where the sheath 91 extends to the interior of the tray 80, the wadding 93 may also be placed on top of the sheath 91, once it is pulled into the interior of the tray 80, to further protect the tray 80 from contamination.

As will be understood by one skilled in the art, in each of the embodiments described above, the press system may also include a controller to coordinate operation of the washer system. Notably, the controller may be configured to control a plurality of individual press washer systems. The controller is provided with an operator panel having various controls, so that the press operator may enter system parameters such as which press washer to engage, the amount and duration of solvent fluid supply (spray time), the duration of engagement of the blade assembly with the ink roller train (clean time), and the like.

Each press washer system may also feature an air/fluid control box, individually controlled by the system controllers for controlling the supply of compressed air and cleaning solvents from their respective central supplies to the various washings components. Each control box features separate solenoid operated valves for regulating the flow of the solvents and air therethrough. Operation of the solenoids (which are operatively connected to the system controller) controls dispensation of solvent/air to the system components. By entering the appropriate information into the control panel, the press operator may control operation of the individual solenoid in the control boxes to regulate the supply solvent and air to the appropriate washer unit.

Accordingly, the invention provides an improved apparatus for cleaning the rollers of a printing press. Both the sheathing supply system and absorbent wadding eliminate the need to remove cleaning materials after each washing operation, while at the same time keep the system components clean and prolong their life. By use of the pivoting motion of the blade assembly, the sheath is automatically advanced as needed, eliminating operator intervention. Because the sheathing system intermittently advances just the right amount sheathing material necessary for each washup, the life and usefulness of the sheathing supply is significantly increased. It is understood that the present invention may be used with equal facility and advantage with other non-ink rollers, such as with blanket cylinders or impression rollers. By use of a thin sheathing material with a low coefficient of friction (such as Mylar), the device is capable of cleaning the various press rollers (with their varied coverings) that are found on printing presses, while at the same time not inhibiting the blade geometry to effectively clean the roller. The assembly can be easily retrofit onto a wide range of existing press designs, without the need for extraneous heater systems or like devices.

Moreover, although the invention has been described in detail with particular reference to several embodiments, it should be understood that the invention is capable of other and different embodiments, and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only, and do not in any way limit the invention, which is defined only by the claims.

We claim:

1. A method for using a blade assembly in printing press roller washings for cleaning solid and liquid debris from the printing press rollers used in a printing press, comprising the steps of:

advancing clean sheath material covering a blade unit so that the engaging tip of the blade unit is fully sheathed by clean sheath material, said sheath material protecting said blade unit;

selectively positioning a rigid blade assembly into surface engagement with a printing press roller to scrape liquid and solid debris from a printing press roller;

collecting said liquid and solid debris in a collector; and after collecting said debris in said collector, taking up used sheath material on a take-up roll.

2. The method according to claim 1 wherein the sheath material is advanced approximately ¼ inch.

3. The method according to claim 1 wherein selectively positioning a blade assembly into surface engagement with a printing press roller is automatic.

4. The method according to claim 1 wherein the selectively positioning a blade assembly into surface engagement with a printing press woll can be manually overriden.

5. A blade assembly for use in printing press roller washings for cleaning solid and liquid debris from the printing press rollers used in a printing press, comprising:

a) a mounting assembly affixed to said printing press for supporting said blade assembly;

b) an actuator engaged with said mounting assembly to selectively position said blade assembly into surface engagement with a printing press roller and said solid and liquid debris thereon;

c) said blade assembly further comprising a collector;

d) a blade unit attached to said blade assembly in surface engagement with said printing press roller to remove said liquid and solid debris from said printing press roller and to allow said solid and liquid debris to fall into said collector;

e) a substantially liquid impervious sheathing material placed over said blade unit to cover and protect said blade unit; and f) a take-up roll for taking up used sheathing material.

6. The blade assembly according to claim 5 wherein said collector comprises a tray releasably supported by said mounting assembly.

7. The blade assembly according to claim 5 wherein said collector comprises a tray permanently affixed to said mounting assembly.

8. The assembly according to claim 7 wherein said collector further comprises a disposable absorbent lining releasably supported in said tray to absorb said liquid and solid debris.

9. The blade assembly according to claim 8 wherein said sheathing system comprises a detachable shield formed to the dimension of said blade unit.

10. The blade assembly according to claim 5 wherein said actuator is an automatic actuator and said blade assembly further comprises an absorbent lining releasably disposed within said collector to absorb said collected and liquid debris.

11. The blade assembly according to claim 5 further comprising:

a supply roll of said sheathing material, and a supply shaft being provided to support said supply roll.

12. The blade assembly according to claim 11 wherein said supply shaft is mounted to said collector and said take-up shaft is rotatably mounted to said collector.

13. The blade assembly according to claim 12 wherein supply shaft is rotatably mounted to said collector.

14. The blade assembly according to claim 12 further comprising an advancer operatively linked to said supply roll to advance said clean sheath material from said supply roll and a retractor operatively linked to said take-up roll to retract said used sheath material onto said take-up roll.

15. The blade assembly according to claim 14 wherein said advancer and said retractor are operatively linked to each other.

16. The blade assembly according to claim 15 wherein said retractor comprises a first gear and said advancer comprises a second gear in meshing relationship with said first gear.

17. A blade assembly for use in printing press roller washings for cleaning solid and liquid debris from the printing press rollers used in a printing press, comprising:

a) a mounting assembly affixed to said printing press for supporting said blade assembly;

b) an actuator engaged with said mounting assembly to selectively position said blade assembly into surface engagement with a printing press roller and said solid and liquid debris thereon;

c) said blade assembly further comprising a collector;

d) a blade unit attached to said blade assembly in surface engagement with said printing press roller to remove said liquid and solid debris from said printing press roller and to allow said solid and liquid debris to fall into said collector; and e) sheathing material placed over said blade unit to cover and protect said blade unit, wherein said sheathing material has a first end and a second end said first end having a female channel and said second end having a complimentary male channel, said male and female channels forming an interlocking relationship when joined together.

18. A method for using a blade assembly in printing press roller washings for cleaning solid and liquid debris from said printing press rollers used in a printing press, comprising the steps of:

covering a blade unit with a clean liquid impervious sheath material so that the engaging tip of the blade unit is fully covered and protected by said clean liquid impervious sheath material;

selectively positioning said blade unit covered by said liquid impervious sheath material into surface engagement with said printing press roller to remove said solid and liquid debris from said printing press roller;

collecting said solid and liquid debris in a collector;

selectively positioning said blade unit so that it is no longer in surface engagement with said printing press roller; and removing said liquid impervious sheath material from said blade unit.

* * * * *